US006412389B2

(12) United States Patent
Fluhr

(10) Patent No.: US 6,412,389 B2
(45) Date of Patent: Jul. 2, 2002

(54) RETAINER FOR SECURING A SILENCER ON BARREL OF HANDGUN

(75) Inventor: Norbert Fluhr, Oberndorf (DE)

(73) Assignee: Heckler & Koch GmbH, Oberndorf (DE)

( * ) Notice: Subject to any disclaimer, the term of this patent is extended or adjusted under 35 U.S.C. 154(b) by 0 days.

(21) Appl. No.: 09/821,874

(22) Filed: Mar. 30, 2001

(30) Foreign Application Priority Data

Jul. 30, 1999 (DE) ..... 199 35 929
Jul. 19, 2000 (WO) ..... PCT/EP00/06894

(51) Int. Cl.[7] ..... F41A 21/00
(52) U.S. Cl. ..... 89/14.4; 181/223
(58) Field of Search ..... 89/14.4, 14.3, 89/14.05; 181/217, 223; 42/75.01

(56) References Cited

U.S. PATENT DOCUMENTS 2,101,849 A * 12/1937 Green ..... 89/14.4
4,429,614 A 2/1984 Tocco ..... 89/14
4,530,417 A * 7/1985 Daniel ..... 181/223
4,576,083 A * 3/1986 Seberger, Jr. ..... 89/14.4
4,726,280 A 2/1988 Frye ..... 89/16
4,974,489 A * 12/1990 Fishbaugh ..... 89/14.4
5,433,133 A 7/1995 La France ..... 89/14.2
5,679,916 A 10/1997 Weichert ..... 89/14.4

FOREIGN PATENT DOCUMENTS

DE 2824546 A1 12/1979

OTHER PUBLICATIONS

Official Search Report of EPO/ISA from PCT/EP 00/06894.

* cited by examiner

*Primary Examiner*—J. Woodrow Eldred
(74) *Attorney, Agent, or Firm*—Marshall, Gerstein, & Borun.

(57) ABSTRACT

A retainer for securing a silencer to a barrel of a handgun is disclosed. The retainer includes a counter-attachment on the barrel of the handgun for attaching the barrel to the retainer, and also includes a forward part for receiving the silencer. A bore extends through the retainer for receiving the counter-attachment, and the inner profile of the bore and the outer profile of the counter-attachment define at least one gas expansion chamber between the counter attachment and the bore when the counter-attachment is disposed in the bore. A lock on the retainer engages a collar on the counter-attachment, thereby releasably securing the counter-attachment in the bore.

18 Claims, 4 Drawing Sheets

RETAINER FOR SECURING A SILENCER ON BARREL OF HANDGUN

RELATED APPLICATIONS

This application claims priority under 35 U.S.C. §120 from PCT Application Ser. No. PCT/EP00/06894, filed Jul. 19, 2000.

FIELD OF INVENTION

The present invention relates generally to firearms, and particularly, to a retainer for securing a silencer on barrel of handgun. The retainer can be integral with the silencer, or may be affixed to the same. Likewise the retainer can be integral with the gun barrel, or may be affixed to the same.

BACKGROUND

In the following, "forward" (and its derivatives) is to be understood as "in the direction of firing."

A retainer for a removable silencer for a handheld firearm must at a minimum fulfill two requirements. First, the retainer must be self centering, such that upon attachment, the longitudinal bore axes of the silencer and the barrel must exactly coincide. Second, the retainer attaching the silencer to the barrel must provide a gas tight seal relative to the combustion gases emitted from the barrel. These combustion gases exhibit the highest emission pressure in the area of the silencer. Upon firing, a slight failure in the seal can cause combustion gases to escape at supersonic speeds, thereby entering the surrounding atmosphere and producing a definite report.

Almost always, gas is emitted from the transitional zone between the cylinder and the bore of a revolver and gives rise to an expansion report, which reduces the action of a silencer to such a point, that as a rule, one refrains from equipping a revolver with a silencer.

To meet the self centering requirement, complementary, precision-fit cylindrical seating is typically provided on both the silencer and the barrel in a coaxial relation. The coaxial seating allows both parts to be pushed into one another with as little play as possible. For sealing against gas escape, as a rule, a fine threading is employed, which is at least several threads deep and thereby provides a sufficient, gas blocking labyrinth, as has been disclosed by DE 42 31 183 C1.

Since the process of screwing on the silencer is time consuming and requires a certain degree of digital dexterity in order not to damage the very fine threads, a precision fit can also be used instead of threads as a sealant for the combustion gas. To use a precision fit as a sealant, however, requires that the precision-fit zones formed by the complimentary cylindrical surfaces of the barrel and the silencer are long enough to prevent gas leakage, which might be caused by the pressure-instigated retractions of the precision fit surfaces. Additionally, any scratches and faults on the surfaces could further cause leaks. Thus, even with long enough precision fit surfaces, extensive firing of the weapon can eventually lead to gas leaks, which results in the presence of expansion reports.

The hurried pushing together of the two long, precision fit cylindrical components is not simple and thus attaching a precision fit silencer may take just as long as the above mentioned threaded attachment of the silencer. It is possible that jamming can happen, and indeed, it is very possible when the precision-fit cylinders have acquired dirt thereon. Additionally, powder residue which has deposited on the precision-fit surfaces especially obstructs the withdrawal of the silencer from the gun barrel.

From the foregoing, persons of ordinary skill in the art will appreciate that it is desirable to provide a retainer for a silencer on the barrel of a firearm, wherein the slipping on of the silencer onto the barrel is possible without encountering jamming or the like, and further, wherein pronounced expansion reports are eliminated.

Further, it is desirable to ease the withdrawal of the silencer from the barrel. In order to achieve the goal of easing the withdrawal of a precision-fit silencer from the barrel, certain practical steps are typically taken, including: (a) designing the cylindrical precision fit zone as long as possible in order to obtain a good centering and especially a good sealing, even if the precision-fit zone does not lead to a solid fit; (b) to the extent possible, making the precision-fit zone smooth and of unbroken continuity in order to provide an easy sliding together of the cylindrical surfaces; and, (c) designing a conical introductory stage, such that, upon entry of the silencer, the cylindrical surfaces align themselves with respect to one another before they reach touch-engagement in the precision-fit zone.

Such a retainer is necessarily rather long. Further, powder deposits, which accumulate in the precision-fit zone, still make the withdrawal of the silencer from the barrel of the firearm difficult, although this difficulty may be somewhat reduced if the precision-fit has sufficient looseness.

DETAILED DESCRIPTION OF THE PREFERRED EXAMPLE

Figure 1:
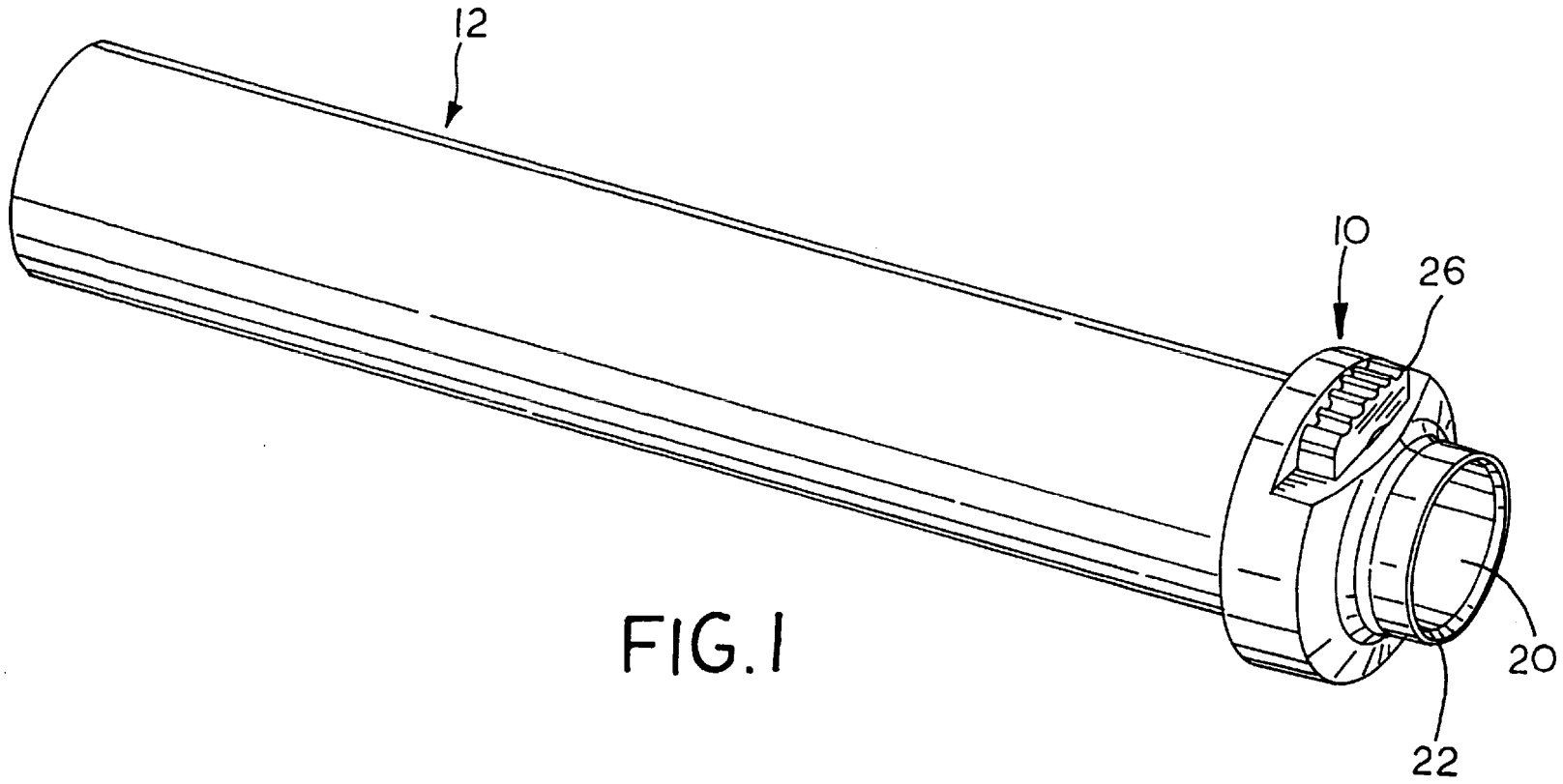
FIG. 1 is an isometric view of an exemplary silencer with a retainer constructed in accordance with the teachings of the present invention.
Figure 2:
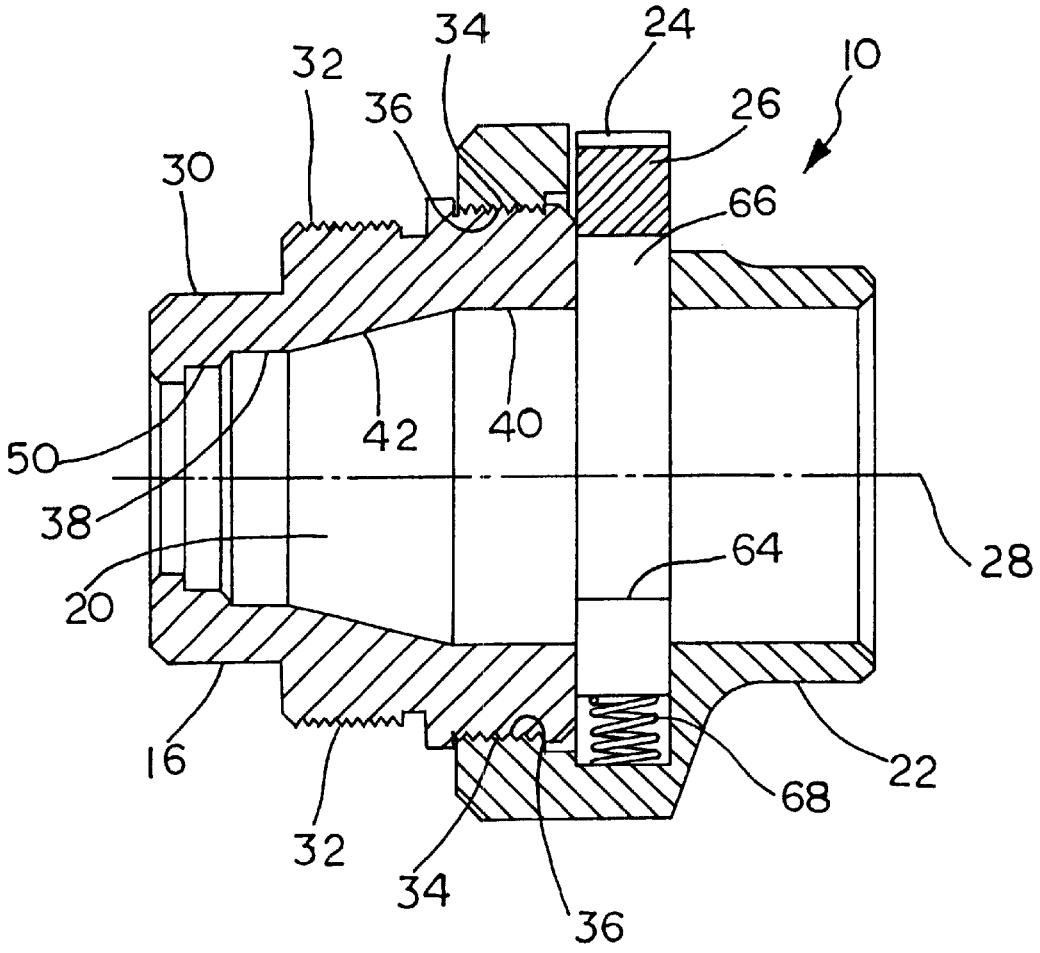
FIG. 2 is an elevational cross-sectional view of the retainer of the FIG. 1.
Figure 3:
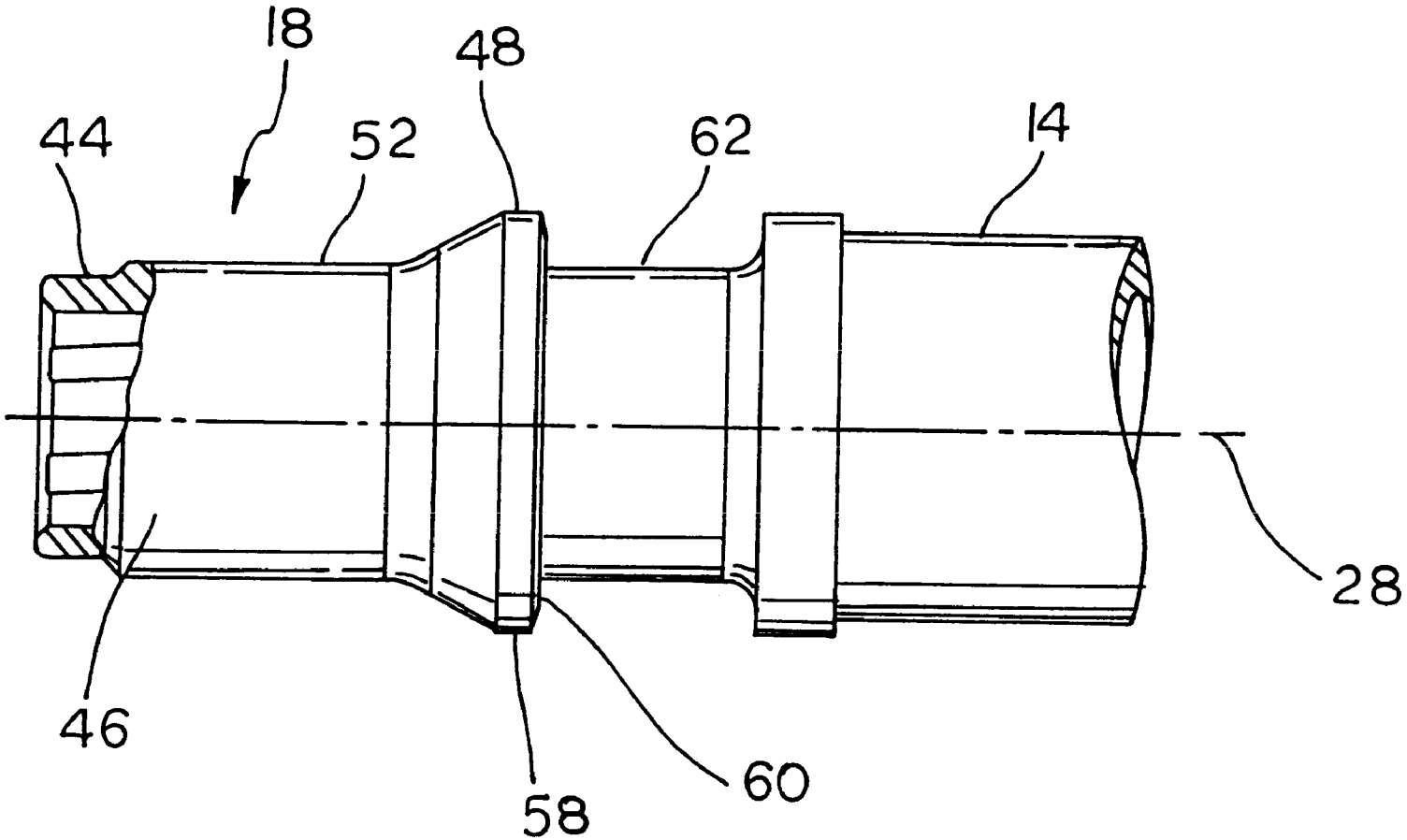
FIG. 3 illustrates an exemplary barrel of a firearm constructed in accordance with the teachings of the present invention.
Figure 4:
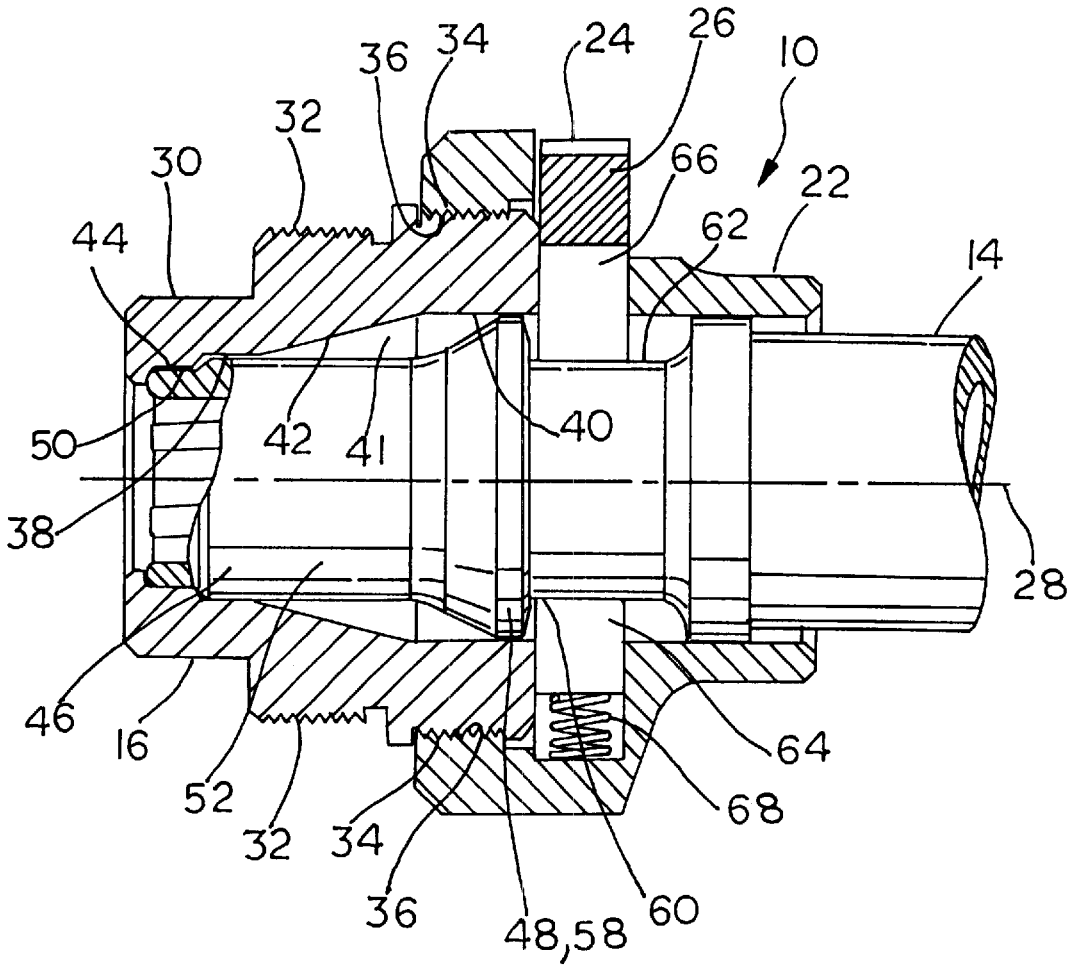
FIG. 4 shows the barrel of FIG. 3 inserted in the retainer of FIG. 2.

Referring to FIGS. 1–4, a retainer 10 for securing a silencer 12 (shown in FIG. 1) to a barrel 14 (shown in FIG. 3) of a handgun (not shown) is shown. The silencer 12 attaches to the retainer 10 at a forward part 16 of the retainer 10, and a counter-attachment 18, which is on the barrel 14, is inserted in a bore 20 of the retainer 10 at a rear part 22 of the retainer 16. The counter-attachment 18 locks in the retainer 16 with lock 24 when fully inserted therein. The lock 24 can be released with a handgrip 26 to disengage the retainer 10 from the counter-attachment 18. The longitudinal axes of the retainer 10, the silencer 12, and the counter-attachment 18 coincide with the longitudinal bore axis 28 of the barrel 14 when the disclosed device is operational. FIG. 3 shows the barrel 14, onto which the counter-attachment 18 has been integrated. The counter-attachment 18, however, may be a separate component that is fastened to the barrel 14 in a gas-tight manner, for example, by soldering.

FIG. 2 illustrates the retainer 10 in greater detail. The forward part 16 is a rotatable component that includes a machined precision seat 30, a forward fine threading 32, and a rear fine threading 34 on its outer surface. Threading on the outer tube of the silencer 12 matches the forward fine threading 32 for attachment of the silencer 12 onto the forward part 16, wherein the silencer 12 seats exactly centered on the precision seat 30. The rear fine threading 34 attaches to a counter-threading 36 on the rear part 22. The forward part 16 is bored centrally along the bore axis 28, wherein the diameter of the bore 20 increases from the front to the back of the forward part 16. In the of the forward part 16, the diameter of the bore 20 is slightly larger than the diameter of the bullet to be shot in the barrel 14. Behind the front of the forward part 16, the bore 20 enlarges to a cylindrical, forward precision bore 38. The forward precision bore 38 transitions to a rear precision bore 40 at the rear of the forward part 16, wherein the transition defines a conical bore 42.

FIG. 3 illustrates the barrel 14 and the counter-attachment 18 in greater detail. The counter-attachment 18 includes a nozzle 44, a forward precision cylinder 46, and a rear precision cylinder 48. Upon insertion of the barrel 14 into the retainer 10, the nozzle 44 seats in a recess 50 in the bore 20, which is formed in front of the forward precision bore 38 of the forward part 16. The length and diameter of the rear precision cylinder 48 are so determined to engage the rear precision bore 38 without any play when the forward precision cylinder 46 is fitted exactly into the forward precision bore 38. A section with a cylindrical outer surface 52 connects the forward and rear precision cylinders 46 and 48. The cylindrical outer surface 52 can be integral with the forward and rear precision cylinders 46 and 48 or it can be made with threaded end for a detachable connections.

Referring to FIG. 3, when the forward part 16 is fully pushed onto the barrel 14, it is centered by the forward and rear precision bores 38 and 40. The connection of the barrel 14 with the forward part 16 is formed by the forward precision cylinder 46 seating play-free in the forward precision bore 38, and the rear precision cylinder 48 seating play-free in the rear precision bore 40. As a result, an expansion chamber 41 is created in an annular space between the counter-attachment 18 and the bore 20. High pressure gas from firing penetrates a first precision joint 54 between the forward precision bore 38 and the forward precision cylinder 46 and fills the expansion chamber 41. The gas subsequently penetrates a second precision joint 56 between the rear precision cylinder 48 and the rear precision bore 40 for release into the atmosphere. The pressure of the gas quickly drops before penetrating the first precision joint 54 and only builds moderately in the expansion chamber 41. After penetrating the second precision joint 56, the gas pressure is so reduced that it does not cause any noticeable report of an expansion.

In case an expansion is reported after the gas penetrates the second precision joint 56, a second expansion chamber can be easily provided behind the second precision joint 56 by installing a third precision joint.

The rear precision cylinder 48 forms a collar 58 around the barrel 14. In the disclosed embodiment, the diameter of the collar 58 continually increases from the front of the barrel 14 to the back. In further accord with the disclosed embodiment, at the back side of the collar 58, the diameter of the barrel 14 decreases radially to form an abrupt offset at right angles to the bore axis 28. The offset forms a front wall 60 of a circumferential groove 62 about the circumference of the barrel 14.

The rear part 22 includes a lock 24 which becomes aligned with the circumferential groove 62 when the barrel 14 is fully inserted into the retainer 10. The lock 24 is moveable in a direction transverse to the bore axis 28 of the bore 20 at the rear side of the front part 16.

The lock 24 is designed as a flat, circular ring 64 with an outside diameter slightly larger than the diameter of the rear precision cylinder 48. On its outer circumference, the ring 64 projects radially outward through a cutout 66 in the rear part 22. Further, the ring 64 has an accessible handgrip 26. Diametrically opposite to the handgrip 26 is a compressed spring 68 positioned between the ring 64 and the inner surface of the rear part 22. The spring biases the ring 64 and the handgrip 26 outward through the cutout 66.

Assembly of the retainer 10 is performed by initially inserting the lock 24 and spring 68 in the rear part 22. Thereafter, the forward part 16 is attached to the rear part 22 through a complementary opening in the rear part 22 with rear fine threading 34 and counter-threading 36. The threaded connection between the forward part 16 and the rear part 22 puts the rear of the forward part 16 in a border-line relation with the movement space of the ring 64.

When the silencer 12 with the retainer 10 is pushed onto the barrel 14, the forward and rear precision cylinders 46, 48 slide into the forward and rear precision bores 38 and 40, respectively. Concurrently, the collar 58, with its increasing diameter presses against the inside diameter of the lock 24 and pushes the ring 64 transversly against the force of the spring 68. The ring 64, therefore, slides over the forward and rear precision cylinders 46 and 48, and over the collar 58 until it drops into the circumferential groove 62 of the barrel 14. The engagement of the ring 64 with the circumferential groove 62 occurs when the forward precision cylinder 46 strikes against the most forward end of the bore 20 of the forward part 16 of the retainer 10. Furthermore, engagement of the lock 24 aligns the bore axis of the silencer 12 with the bore axis 28. The conical bore 42, which partially forms the expansion chamber 41 guides the forward and rear precision cylinders 46 and 48 through the forward and rear precision bores 38 and 40, respectively. The lock 24 snaps into engagement with the circumferential groove 62 because the spring 68 is initially compressed. The ring 64 also engages the front wall 60 of the circumferential groove 62. The lock 24 is slightly inclined on its forward face for pressing against the front wall 60, resulting in the barrel 14 being pressed into the forward part 16. Therefore, the advantage of the disclosed device is that the silencer 12 can be brought into operation with only a single manual operation.

For the removal of the silencer 12 and the retainer 10, the handgrip 26 of the lock 24 must be pressed inward and the retainer 10 pulled away from the barrel 14. During the operation of the retainer 10, the forward and rear precision bores 38 and 40 may become coated with residues from the gun powder smoke. The force required to withdraw the retainer 10, therefore, may be higher than normal. However, the force required is less than the force that would be needed to withdraw the retainer 10 from the barrel 14 if the axial length of the first and second precision joints 54 and 56 were larger. The advantage of the disclosed device is that the axial length of the first and second precision joints 54 and 56 is short, thus minimizing the force required to withdraw the retainer 10 from the barrel. Furthermore, with the disclosed device, only a fifth of the withdrawing force is necessary as compared to that required if the first and second precision joints 54 and 56 were stretched continuously along the retainer 10.

The precision joints of the disclosed device are not particularly long, nor are they discontinuous. The purpose of the disclosed device is achieved by the first and second precision joints 54 and 56 creating an expansion chamber 41. The first and second precision joints 54 and 56 define circumferential joint areas that enclose the expansion chamber 41. The centralizing of the axes of the components of the disclosed device and the precision fit of the components is achieved at the circumferential precision joint areas just before and behind the expansion chamber.

If a precision joint were constructed with a length equal to the cumulative lengths of the precision joint areas of the disclosed device, the precision joint would not alone provide a satisfactory high pressure seal. The advantage of the disclosed device is that the precision joint areas are spaced apart to create an expansion chamber 41 in the space. The first precision joint 54 which is adjacent to the silencer 12 allows penetration of combustion gases into the expansion chamber 41 behind it. The pressure of the gases drop sufficiently in the expansion chamber 41 to result in a non-noticeable report of an expansion when the gases exit into the atmosphere.

However, if further suppression of expansion reports is necessary, several additional rear expansion chambers may be placed sequentially, which may be respectively separated from one another by additional precision joint areas. The combustion gases then release their compression stage-wise in the succeeding expansion chambers. The combustion gases are permitted into the atmosphere from the last of these expansion chambers, at which point, the pressure of the gases is so diminished no disturbing expansion report is created. The disadvantage associated with installation and removal of a silencer, which is the precision fitting of two long precision surfaces, can be overcome with the use of the disclosed device because the only precision-fit areas are along at the precision joint areas.

The precision fitting of the precision joint areas is advantageous because they are very short. Preferably, only two precision joint areas are provided. Consequently, the corresponding precision cylinders and precision bores can be simply finished to the desired quality level, i.e. polished, ground, etc. than in the case of long, precision cylinders or precision bores.

If, as is advantageous, the joint areas are successively larger in diameter towards the rear, then sliding the silencer onto the barrel, or removing of the silencer from the barrel is sufficient only over such a distance as corresponds to the longest joint, since the external circumference of the barrel in the most forward joint area, can no longer make precision contact with the larger inner circumference of the silencer or its retainer in the most rearward joint.

Under such circumstances, it may be pointed out that the centering is dependent only upon the distance between the most forward and the most rearward precision joint areas.

Therefore, a quick installation and removal of the retainer 10 becomes possible. Nevertheless, the retainer 10, however, must be secured on the barrel 14 by the lock 24 following installation on the barrel 14.

A bayonet clamp can be provided for the handgun, which can anchor on a sight base at the forward end of the barrel 14. The disadvantage of providing a bayonet clamp is that the retainer 10 set on the forward sight base or on a similar protrusion must be aligned with the barrel 14. The disclosed device provides the spring loaded transverse lock 24, which is engages the circumferential groove 62 about the outer surface of the barrel 14.

By applying pressure on the transverse lock 24 against the spring 68, the lock 24 can be pushed back at right angles to the bore axis 28. Then, the silencer 12 can be pushed onto the barrel 14 with no difficulty or can be withdrawn therefrom.

The disclosed device provides an advantage when the forward and rear precision cylinders 46 and 48 have different diameters. In this case, a taper forms on the barrel 14, wherein the ring 64 runs up on the tapered part and is displaced transversely to the bore axis 28 until it drops into the circumferential groove 62. An activation of said lock 24 is not required upon the pushing on of the silencer 12 on the barrel 14.

In the disclosed embodiment, the size of the expansion chamber 41 is dependent on the size of the tapering between the forward and rear precision cylinders 46 and 48.

With the disclosed device, traces of smoke deposition may be found after a series of firings. However, no expansion report will be heard after firing because the expansion chamber 41 sufficiently reduces the pressure in front of the first precision joint 54 to prevent the occurrence of a disturbing expansion report.

Although certain examples have been shown and described in this patent, the scope of this patent is not limited to these examples. On the contrary, the scope of this patent is defined by the claims that follow.

What is claimed is:

1. A retainer for securing a silencer to a barrel of a handgun comprising:

a counter-attachment adapted for attachment to the barrel, the counter-attachment including a collar;

a forward part adapted to receive the silencer;

a bore extending through the retainer, the bore sized to receive therein a forward portion of the counter-attachment;

a securing mechanism arranged to releasably engage the collar when the forward portion of the counter-attachment is disposed in the bore thereby securing the counter-attachment in the bore; and at least one expansion chamber formed between an inner surface of the bore and an outer surface of the counter-attachment when the counter-attachment is secured in the bore.

2. The retainer of claim 1, wherein the bore comprises:

a forward portion;

a rearward portion; and wherein the inner surface of the bore includes a transition surface extending between the forward portion and the rearward portion.

3. The retainer of claim 2, wherein the counter-attachment comprises:

a forward cylinder;

a rearward cylinder; and wherein the outer surface of the counter-attachment includes a transition surface extending between the forward cylinder and the rearward cylinder.

4. The retainer of claim 3, wherein the expansion chamber is bounded by:

a first joint between the forward cylinder and the forward portion of the bore;

a second joint between the rearward cylinder and the rearward portion of the bore, the second joint having a diameter larger than a diameter of the first joint.

5. The retainer of claim 1, wherein the securing mechanism comprises a lock ring engaging a rearward circumferential wall of the collar, the lock ring being adapted to bias the counter-attachment in a forward direction into the bore.

6. The retainer of claim 1, in combination with the barrel, and wherein the counter-attachment is integrally formed with the barrel.

7. The retainer of claim 1, in combination with the barrel, and wherein the counter-attachment is fastened to the barrel.

8. The retainer of claim 7, wherein the counter-attachment is fastened to the barrel by soldering.

9. A retainer for securing a silencer to a barrel of a firearm comprising:

a counter-attachment adapted for attachment to the barrel, the counter-attachment having an external surface defining a first transitional profile;

a forward part adapted to receive the silencer;

a bore having an internal surface defining a second transitional profile different than the first transitional profile, the first transitional profile and the second transitional profile cooperating when the counter-attachment is disposed in the bore to form an expansion chamber; and a securing mechanism arranged to releasably secure a forward portion of the counter-attachment in the bore.

10. The retainer of claim 9, wherein the external surface of the counter-attachment comprises:

a forward cylinder;

a rearward cylinder; and wherein the first transitional profile extends between the forward cylinder and the rearward cylinder.

11. The retainer of claim 9, wherein the bore further comprises:

a forward portion defining a forward end of the expansion chamber;

a rearward portion defining a rearward end of the expansion chamber; and wherein the second transitional profile includes a conical portion extending from adjacent the forward end toward the rearward end.

12. The retainer of claim 11, wherein the forward end of the expansion chamber includes a first diameter and wherein the rearward end of the expansion chamber includes a second diameter larger than the first diameter.

13. The retainer of claim 9, wherein the securing mechanism comprises a lock ring having an aperture sized to receive a collar carried by the counter-attachment, the lock ring being shiftable an unlocked position in which the aperture is generally concentric with the bore to a locked position in which the aperture is non-concentric with the bore, the lock ring engaging the collar when in the locked position.

14. The retainer of claim 13, wherein the lock ring engages a rearward circumferential wall of the collar when the counter-attachment is disposed in the bore, the lock ring adapted to bias the counter-attachment in a forward direction into the bore.

15. The retainer of claim 9, in combination with the barrel, and wherein the counter-attachment is integrally formed with the barrel.

16. The retainer of claim 9, in combination with the barrel, and wherein the counter-attachment is fastened to the barrel.

17. The retainer of claim 16, wherein the counter-attachment is fastened to the barrel by soldering.

18. A retainer for securing a silencer to a barrel of a handgun comprising:

a counter-attachment adapted for attachment to the barrel, the counter-attachment including a collar;

a forward part adapted to receive the silencer;

a bore extending through the retainer, the bore sized to receive therein a forward portion of the counter-attachment;

a securing mechanism arranged to releasably engage the collar when the forward portion of the counter-attachment is disposed in the bore thereby securing the counter-attachment in the bore; and means for defining a gas expansion chamber between the counter-attachment and the bore.

* * * * *